United States Patent [19]

Glaser et al.

[11] 4,423,799

[45] Jan. 3, 1984

[54] VEHICLE DOOR LOCK FOR LIMITING DOOR OPENING TO SPECIFIED VEHICLE POSITIONS

[75] Inventors: Walter Glaser, Montvale; Herbert P. Glaser, Demarest, both of N.J.

[73] Assignee: G.A.L. Manufacturing Corporation, Bronx, N.Y.

[21] Appl. No.: 334,533

[22] Filed: Dec. 28, 1981

Related U.S. Application Data

[63] Continuation-in-part of Ser. No. 201,307, Oct. 7, 1980, Pat. No. 4,364,454.

[51] Int. Cl.[3] ..... B66B 13/00

[52] U.S. Cl. ..... 187/57; 187/61; 49/116

[58] Field of Search ..... 187/57, 49, 61, 50, 187/52 LC, 56, 32, 31; 49/404, 116, 31

[56] References Cited

U.S. PATENT DOCUMENTS 3,912,049 10/1975 Holland et al. ..... 187/61

OTHER PUBLICATIONS

Moline Accessories Co.; 5447 Bird Ave.; Moline, Ill. 61265; regarding the ANSI A17.1 Code Device; Dec. 17, 1980.

*Primary Examiner*—Joseph J. Rolla
*Assistant Examiner*—Kenneth Noland
*Attorney, Agent, or Firm*—Brooks, Haidt, Haffner & Delahunty

[57] ABSTRACT

A locking mechanism for the doors of an elevator car which is disabled when the car is within a short distance from a landing but which otherwise permits the doors to be opened by an amount insufficient for a passenger to exit from the car and then locks the doors with respect to further opening movement. In the preferred form, a door carries a notched plate, and a latch bolt on a part of the car which is stationary relative to the door is controlled by an arm engageable with spaced cams in the hoistway so that the bolt will enter the notch of the plate when the car is away from a landing and the doors are partially opened.

6 Claims, 25 Drawing Figures

VEHICLE DOOR LOCK FOR LIMITING DOOR OPENING TO SPECIFIED VEHICLE POSITIONS

This application is a continuation-in-part of our co-pending application Ser. No. 210,307, filed Oct. 27, 1980 now U.S. Pat. No. 4,364,454.

The invention relates to a door lock for a passenger carrying vehicle which prevents a passenger within the vehicle from opening the door or doors of the vehicle by an amount sufficient to permit the passenger to exit from the vehicle unless the vehicle is within a specified distance from a point at which the passengers normally leave the vehicle and in particular, relates to a locking mechanism for the doors of an elevator car which locks and prevents opening of the car doors by a passenger within a car by an amount sufficient to permit the passenger to exit from the car unless the car is close to a landing.

Although the invention has other uses, it will be described as applied to an elevator car.

It sometimes happens that the movement of an elevator car stops for various reasons, e.g. a power or control failure etc. If the car stops close to a landing where a passenger may exit from the car, there is no objection to permitting a passenger to force the car doors open manually since the landing doors may be opened, or are open, and the passenger may exit safely. However, if the floor of the car is a substantial distance from level with the landing floor, a passenger, while exiting from the car, may fall under the car into the hoistway. In the past, the car door was, on some elevators, held closed by keeping the door closing mechanism energized, but such expedient is not sufficient to prevent a passenger in the car from prying the door open. Also, with a power failure, the mechanism is no longer energized.

Recent elevator codes specify that the car or hoistway doors must be arranged so that they cannot be opened more than four inches from inside the car when the car is outside the landing zone, e.g. when the floor of the car is more than a short distance from being level with a landing floor. Such code also specifies that when the car door is so arranged, the car door shall be openable from outside the car without special tools for the purpose of rescuing the passengers within the car.

None of the prior art discloses apparatus which meets both these requirements, and while it may be possible to meet the requirements with retracting cams, electrical control circuits dependent upon the operation of other existing control circuits, etc., the latter expedients involve a substantial amount of equipment and system modification. Also, to avoid the noise and wear of a part striking a cam at each floor, it is desirable that any system for meeting the requirements avoid the use of a part which strikes a cam as the car moves in the hoistway.

One object of the invention is to provide a simple combination of parts which may be easily installed and which will prevent the opening of the door or doors of a passenger carrying vehicle by a passenger therein to an extent that a passenger can exit from the vehicle unless the vehicle is within a selected distance from a normal disembarkation point.

Another object of the invention is to provide a car door lock for an elevator car which will meet the elevator code specifications described hereinbefore.

A further object of the invention is to provide apparatus which not only accomplishes the aforesaid objects but also does not have parts which cause undesirable noise with movement of the vehicle.

The preferred embodiment of the invention is entirely mechanical, and the door can be opened from within the vehicle when the vehicle is near a disembarkation point. In other words, the locking mechanism of the preferred embodiment of the invention does not lock a door until a passenger within a vehicle moves the door a small amount and the vehicle is a pre-established distance from a normal disembarkation point. In the preferred embodiment of the invention, a keeper plate having a pair of teeth separated by a notch or gap is mounted on the vehicle door so as to move therewith. A lock bolt or latch which can fit into the notch is mounted on a rotatable shaft mounted on another portion of the vehicle so that when the door is closed, the bolt rests on top of the tooth farther from the door edge. When the door is opened, the bolt moves into the notch and engages a side of the other tooth unless an arm which is also mounted on the rotatable shaft engages a cam located adjacent the path of travel of the vehicle. The length of the cam in the direction of travel of the vehicle is such that the bolt cannot enter the notch when the vehicle is within a short distance from the normal disembarkation point, i.e. the landing zone. Thus, the door will operate normally and can be opened from interiorly of the vehicle when the vehicle is a specified distance from the normal disembarkation point but can be opened only a small amount when the vehicle is more than the specified distance from such point.

In another embodiment, the lock bolt is mounted in a fixed position on the vehicle door, and the notched plate is mounted on another portion of the vehicle and is operated by the shaft-arm-cam combination previously described to provide the same results.

In a further embodiment of the invention, the lock bolt of the first-described embodiment is operable by an electrically energizable solenoid on the vehicle which is controlled by a switch on the vehicle which is operable by either the shaft-arm-cam combination or is controlled by a magnetically operable switch on the vehicle which is operable by plates on the hoistway. In both cases, a separate power supply which can energize the solenoid when the main electrical power has failed is carried by the vehicle.

In a further embodiment of the invention, the latch is operated by a mechanism added to a clutch mounted on the vehicle door, such clutch being used to operate, in a conventional manner, a door providing access to the vehicle at a disembarkation point. The mechanism cooperates with means on the last-mentioned door so that when the vehicle is away from the disembarkation point by a predetermined distance, the latch enters into a notch on said keeper plate as the car door is opened by a small amount. However, when the vehicle is at or away from the disembarkation point by a distance less than said predetermined distance, the means on the door providing access to the car at the disembarkation point maintains the latch out of the notch in the keeper.

Other objects and advantages of the present invention will be apparent from the following detailed description of the presently preferred embodiments thereof, which description should be considered in conjunction with the accompanying drawings in which.

Figure 17:
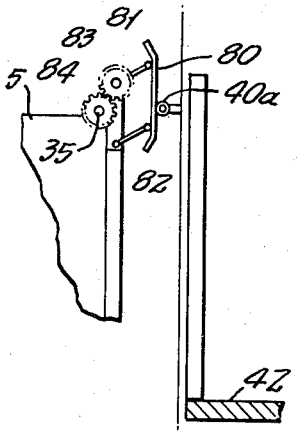
Figure 18:
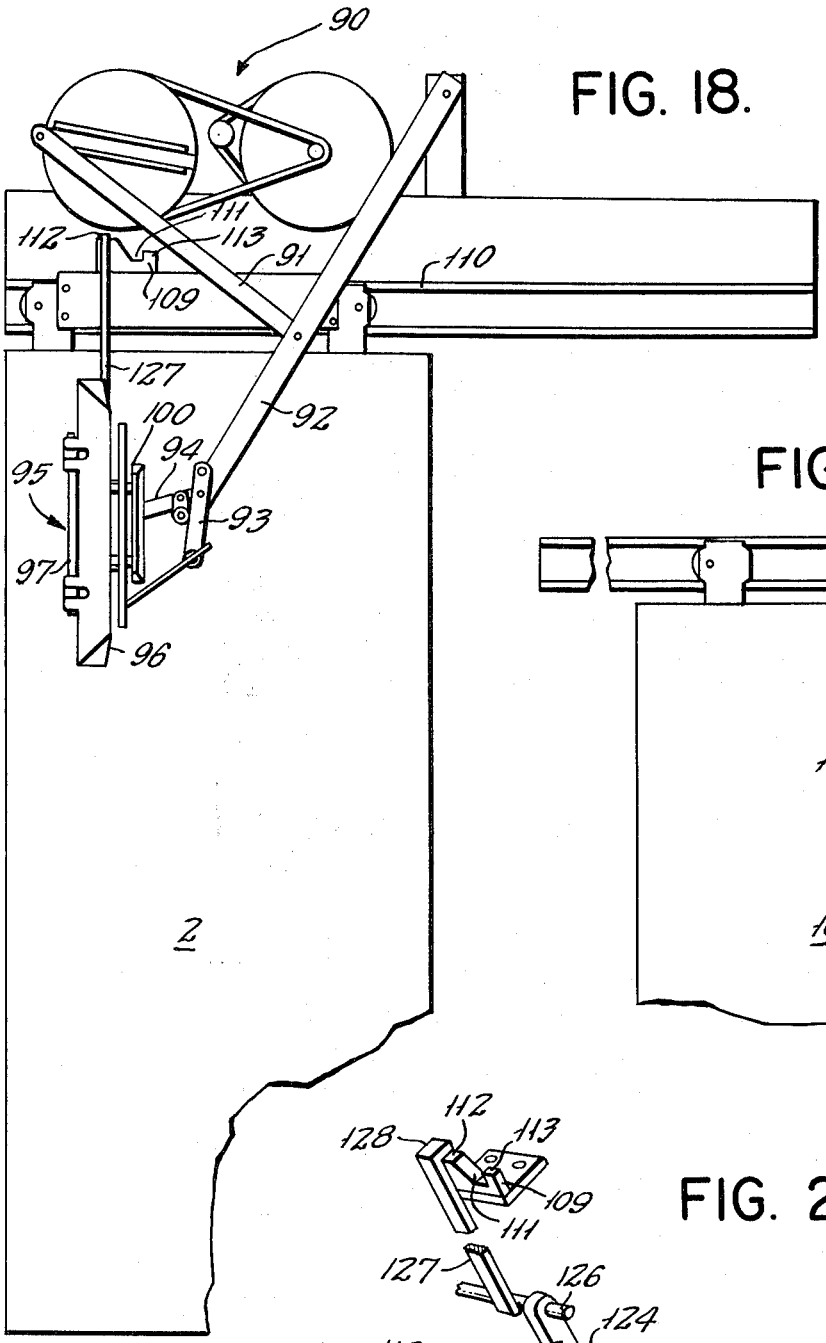
Figure 19:
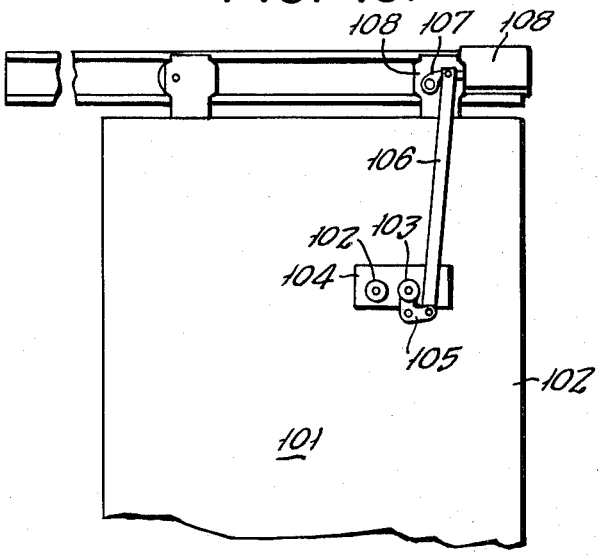
Figure 25:
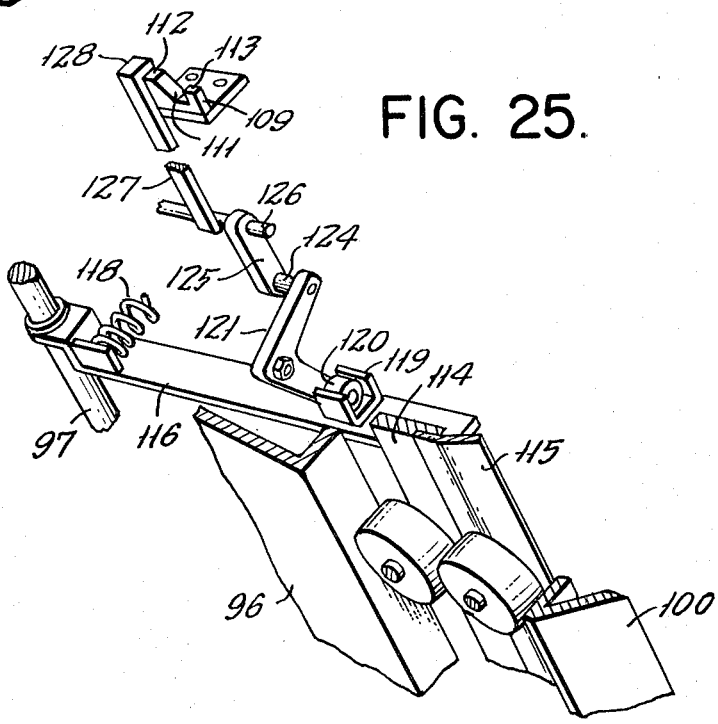
Figure 20:
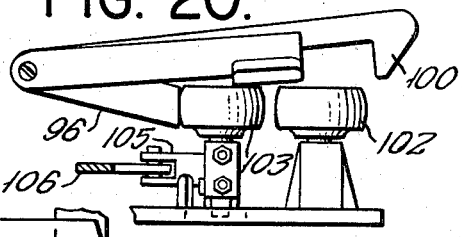
Figure 21:
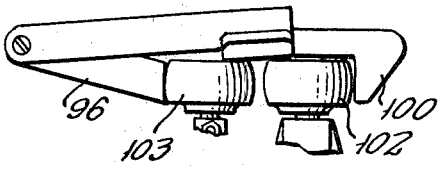
Figure 22:
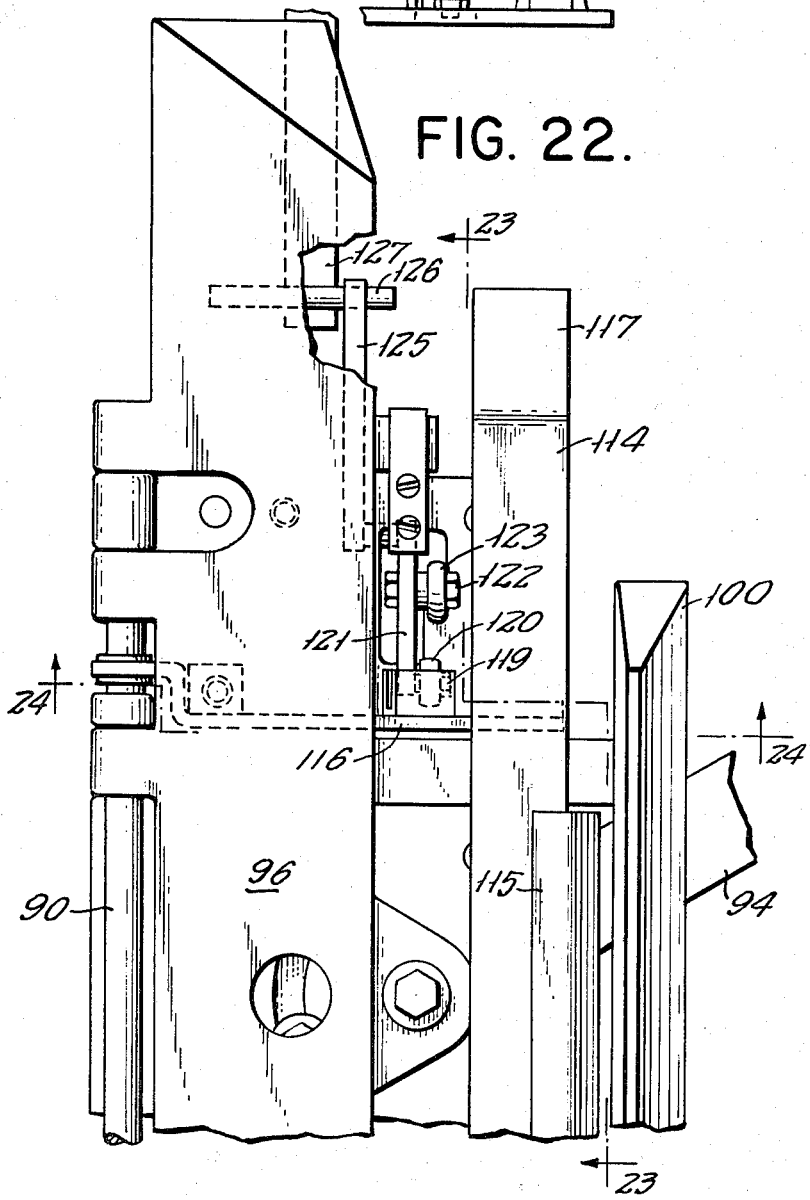
Figure 23:
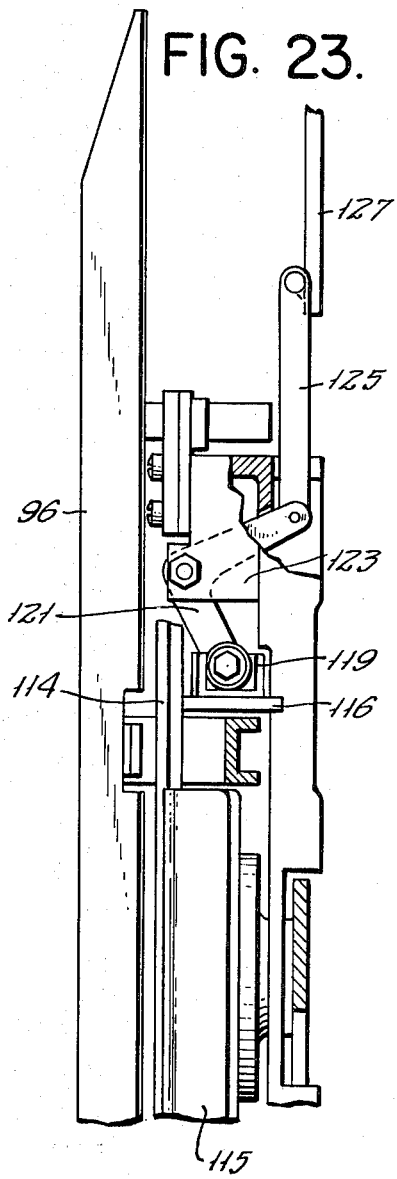
Figure 24:
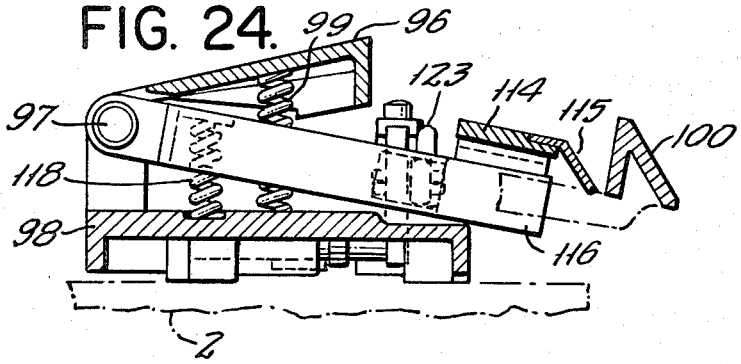

FIG. 17 is a schematic diagram of an alternative arrangement of the cam and roller used in the embodiment shown in FIGS. 1–10, FIG. 18 is a fragmentary, schematic, front elevation view, from the landing side, of a typical elevator car door installation, the hoistway door being omitted for illustration purposes and a modified embodiment of the apparatus of the invention being installed on the car and the car door;

FIG. 19 is a fragmentary, schematic elevation view, from the car side, of a hoistway door used in connection with the car illustrated in FIG. 18;

FIGS. 20 and 21 are enlarged, plan views of a portion of the apparatus shown in FIGS. 18 and 19;

FIGS. 22 and 23 are enlarged, fragmentary, front and side elevation views, respectively, of a portion of the car door apparatus shown in the preceding figures;

FIG. 24 is a cross-sectional view of the apparatus shown in FIGS. 22 and 23 and is taken along the line 24—24 shown in FIG. 20; and FIG. 25 is a schematic perspective view used to illustrate the operation of the embodiment of the invention illustrated in FIGS. 18–24.

Figure 1:
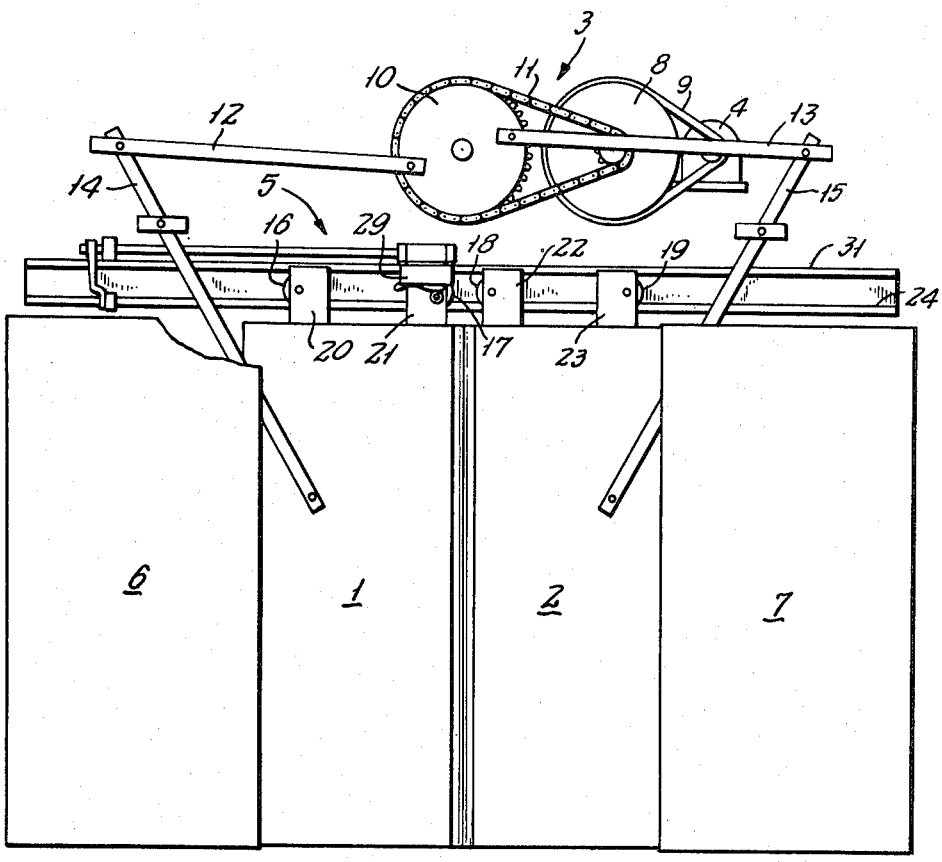
FIG. 1 is a schematic, elevation view, from the landing side, of a typical elevator car door installation, the hoistway doors being opened and the door locking apparatus of the invention being installed on the car and car door.
Figure 2:
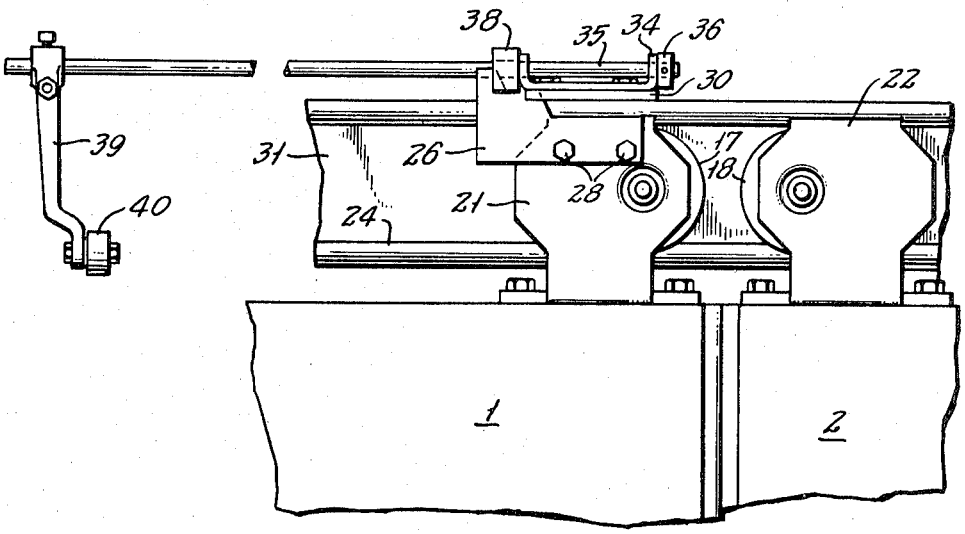
FIG. 2 is a front elevation, enlarged view of a portion of the apparatus showin in FIG. 1.
Figure 3:
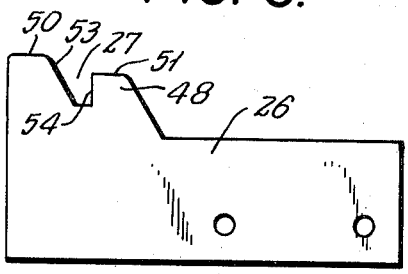
FIG. 3 is an enlarged, front elevation view of a notched plate forming part of the preferred apparatus of the invention.

FIG. 1 illustrates a known type of elevator installation which comprises a pair of sliding or reciprocable car doors 1 and 2 which are opened and closed by a door operating mechanism 3. Although the invention is applicable to other types of installations, the installation may be of the type manufactured and sold by G.A.L. Manufacturing Corporation, 50 East 153rd Street, Bronx, N.Y. The installation illustrated in FIG. 1 comprises an electric motor 4 which is energized by a controller (not shown), which separates the doors 1 and 2 when the car 5 is at a landing and which brings the doors 1 and 2 together when the car 5 departs from a landing. The hoistway doors, which are operated in a conventional manner, are not visible in FIG. 1 since they have been opened, the hoistway door being hidden by walls 6 and 7 at the landing.

A reversible motor 4 drives a pulley 8 by means of a belt 9, and the pulley 8 drives a gear wheel 10 through a chain 11. By means of links 12 and 13 and pivotable levers 14 and 15, the doors 1 and 2 are opened and closed under the control of the controller. It is to be noted that because of the interconnection of the doors 1 and 2 by the links and levers 12–25, the locking of one door in a position will also prevent opening of the other door. Therefore, with the installation illustrated it is necessary to lock only one door when it is desired to prevent passengers from exiting from the car 5. However, if the doors 1 and 2 are not so interconnected, the apparatus of the invention may be applied to both doors.

Sometimes, after the doors 1 and 2 are closed, as shown in FIG. 1, the motor 4 remains energized in the door closing direction so that a substantial force is required to separate the doors 1 and 2 manually. However, the doors 1 and 2 can be pried apart even with such energization of the motor 4, and if the motor 4 is deenergized, such as by reason of a power or control failure, the doors 1 and 2 may be manually separated relatively easily.

The doors 1 and 2 are supported by circumferentially grooved wheels 16–19 rotatably mounted on hangers 20–23 secured to the doors 1 and 2. The wheels 16–19 ride on a rail 24 secured to the car 5.

As pointed out hereinbefore, one objective of the invention is to lock the doors 1 and 2 with respect to manual opening thereof when the car 5 is more than a safe distance, e.g. outside the landing zone, from a landing or floor. This could be accomplished by a detent mechanism which operates when the doors are closed and locks the doors in their fully closed positions. However, such a detent mechanism must be controlled by the control circuits of the installation, requiring wiring and other modifications, or by a cam mechanism which requires striking of a cam by a cam follower when the car approaches the landing, causing undesirable noise and wear. In the preferred embodiments of the invention, the doors 1 and 2 are not locked until they are separated manually by a small amount, e.g. four inches, and there is no striking of a cam follower against a cam as a floor or landing is approached or passed by the car 5.

The locking apparatus of the invention may take various forms, as described hereinafter, but in the preferred forms illustrated in FIGS. 1–10, only mechanical parts are used, and such parts may be easily installed on new or existing elevator installations without modification of the conventional or installed equipment used in an elevator system.

In the preferred embodiments of the invention illustrated in FIGS. 1–10, a plate 26 (see FIGS. 2 and 3) having an aperture therein in the form of a notch 27 is secured to the hanger 21, such as by bolts 28. It is preferred that the plate 26 be secured to the hanger 21 because, in the installation described, the hanger 21 already carries a bracket to which a control switch 29

(see FIG. 1) is secured and the mountings for such bracket may be used to mount a portion of the apparatus of the invention. Also, it is preferred to mount the apparatus of the invention as near as possible to the leading edge of the door 1 to which manual opening force would be applied. However, if desired, the plate 26 may be mounted on the other hanger 20, or on some other part of a door 1 so as to move with the door on which it is mounted.

A bracket 30 (see FIGS. 2, 6 and 7), which may be a modified form of the bracket used to support the switch 29, is secured to the channel 31, such as by bolts 32, which has the rail 24 and an upper rail 33. The bracket 30 has a U-shaped support 34 secured thereto in any desired manner, and the support 34 rotatably supports a rotatable shaft 35. A collar 36 is secured to one end of the shaft 35 preventing movement of the shaft 35 to the left as viewed in FIGS. 2, 6 and 7. The bracket 30 has a cut-out 37 for receiving a portion of the plate 26.

A lock bolt 38 is secured to the shaft 35 so as to move with the shaft 35. The bolt 38 prevents movement of the shaft 35 to the right as viewed in FIGS. 2, 6 and 7. An arm 39 is secured to the shaft 35 so that movement of the arm 39 causes rotation of the shaft 35, and the arm 39 carries a cam follower in the form of a rotatable roller 40.

Figure 8:
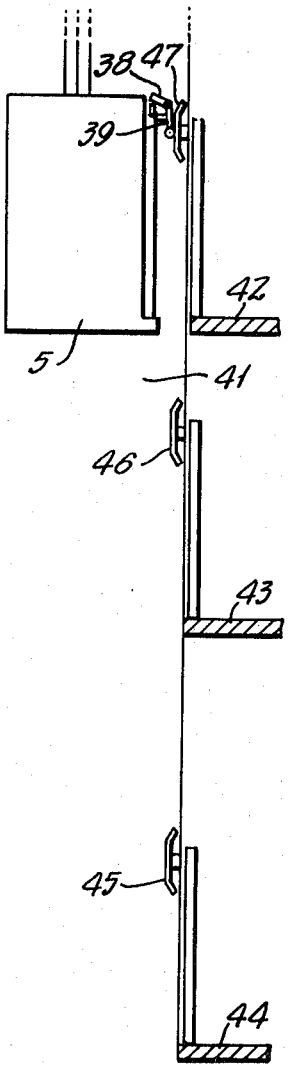
FIG. 8 is a schematic, side elevation view illustrating an elevator car in a hoistway.
Figure 7:
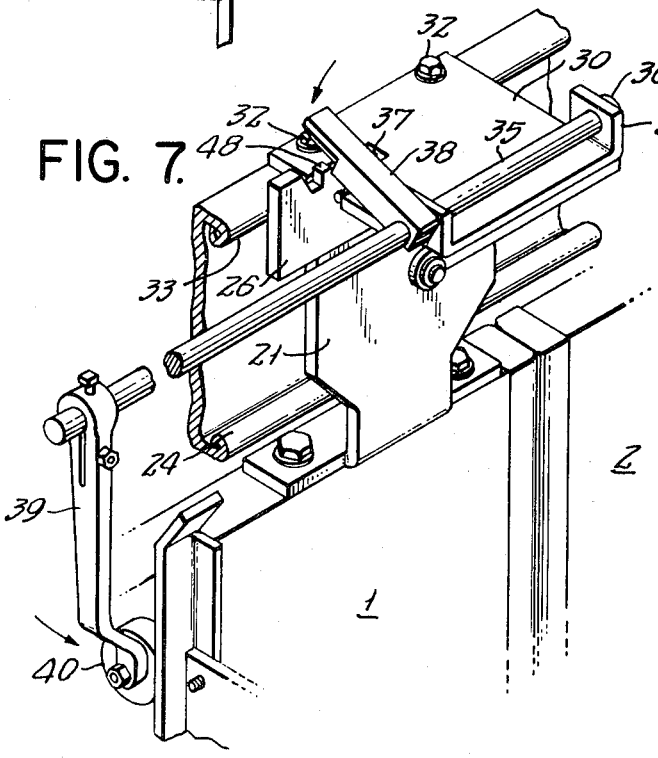
FIG. 7 is a perspective view of a portion of the apparatus shown in FIG. 2.

FIG. 8 schematically illustrates the car 5 in a hoistway 41, the car 5 being movable in a conventional manner between a plurality of floors or landings 42–44, etc. In FIG. 8, the floor of the car 5 is level with the landing 42, and when the floor of the car 5 is close to level with a landing, the locking apparatus of the invention is disabled in the manner described hereinafter. However, when the floor of the car 5 is more than a predetermined distance from level, e.g. outside the landing zone which may, for example, have a length from a few to several inches in the direction of the movement of the car 5, the locking apparatus of the invention is not disabled and is effective to lock the doors 1 and 2 after they have been separated by a small amount, e.g. one to four inches.

The locking apparatus of the invention is disabled, in the embodiments illustrated in FIGS. 1–10, by cams 45–47, etc., one for each floor or landing, which are engagable by the cam follower 40 as the doors 1 and 2 are opened at a landing. When the floor of car 5 is not within a predetermined distance of a landing the follower 40 cannot engage a cam 45, 46 or 47, etc. and the bolt 38 enters into the notch 27 when the doors 1 and 2 are forced open. When the bolt 38 enters the notch 27 further movement of the door 1 to the left, as viewed in FIGS. 1, 2, 6 and 7, and hence, further movement of the door 2 to the right, is prevented by reason of the engagement of the bolt 38 with a side of the projection or tooth 48 (FIG. 3) on the plate 26. The length of the cams 45–47, etc. in the direction of movement of the car 5 is small relative to the distances between the floors 42–44, etc. and is selected so as to define the zone in which the locking apparatus is disabled and the distance between floors that the locking apparatus is operative. In other words, the length of the cams 45–47, etc. is selected so that the locking apparatus locks the doors 1 and 2 against movement by an amount which would permit a passenger in the car 5 to exit from the car 5 when the floor of the car 5 is more than a predetermined safe distance from level with a landing. The length of the cams 45–47, etc. may, for example, be on the order of ten inches but may, if desired, be more or less than ten inches. Generally, speaking, the length of the cams 45–47, etc. is at least equal to the length necessary to permit the doors 1 and 2 to open in elevator systems which commence the opening of the doors 1 and 2 shortly in advance of the time when floor of the car 5 becomes level with a landing and is not large enough to permit a gap of more than about 18 inches between the floor of the car 5 and a landing floor when an attempt is made to separate the doors 1 and 2 manually.

The plate 26 has a surface 50 (FIG. 3) which is farther from the bottom of the notch 27 than the surface 51 of the projection 48. The plate 26, and hence, the surface 50, are positioned relative to the bolt 38 so that the lower surface of the bolt 38 engages the surface 50 when the doors 1 and 2 are fully closed. The arm 39 is adjusted in the direction circumferentially of the axis of the shaft 35 so that the roller 40 is slightly spaced from a cam 45, 46 or 47, etc. when the bolt 38 rests on the surface 50. Of course, the cams 45–47, etc. may be made adjustable toward and away from the car 5 so that the roller 40 is slightly spaced from each cam when the bolt 38 rests on the surface 50. By such adjustment of the parts, the roller 40 does not strike a cam as the car 5 approaches a landing and the noise of the striking of a cam follower against a cam is avoided. Also, since roller 40 does not strike a cam, no parts move thereby eliminating unnecessary wear.

However, the position of the parts, i.e. cams and arm, are also adjusted in relation to the surface 51 so that when the car 5 is at a landing and the doors 1 and 2 are opened, the roller 40 engages a cam and prevents the bolt 38 from entering the notch 27, i.e. maintains the lower surface of the bolt 38 at or above the level of the surface 51. In this way, the locking apparatus of the invention is disabled when the floor of the car 5 is within a predetermined distance from a landing, and the doors 1 and 2 may be opened in the normal manner or manually.

Figure 5:
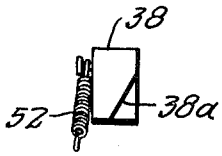
FIGS. 4 and 5 are, respectively, front elevation and end elevation views of a lock bolt forming part of the preferred apparatus of the invention.
Figure 4:
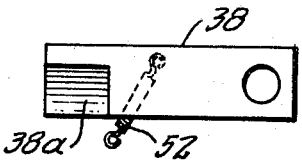
Figure 6:
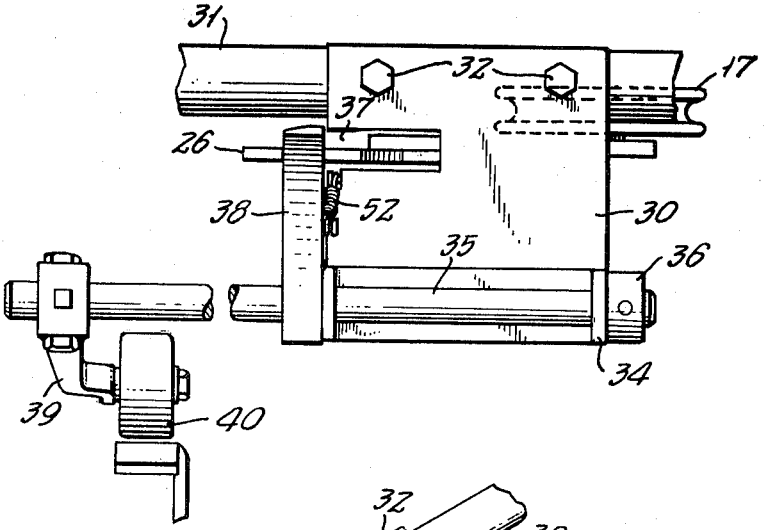
FIG. 6 is a plan view of a portion of the apparatus shown in FIG. 2.

With the foregoing in mind, let it be assumed that the parts of the locking apparatus of the invention have been properly adjusted as described and that the car 5 arrives at the landing 42 with its doors 1 and 2 closed. At this point, the bolt 38 rests on the surface 50 and is urged thereagainst by a spring 52 (FIGS. 4–6). In approaching the landing 42, the roller 40 did not strike the cam 47 because the engagement of the bolt 38 with the surface 50 maintained the roller 40 in spaced relation to the cam 47. The doors 1 and 2 are then opened by the conventional control apparatus, and as the door 1 moves to the left, carrying the plate 26 with it, the bolt 38 rides off the surface 50 and commences to move toward the notch 27. However, such movement of the bolt 38 toward the notch 27 is arrested by engagement of the roller 40 with the cam 47 at a position such that with continued movement of the door 1 to the left, the surface 51 passes under the bolt 38. Accordingly, opening of the doors 1 and 2 in the normal manner is not prevented.

When the car doors 1 and 2 thereafter close, the surface 51 of the plate 26 again passes under the bolt 38, and the sloping surface 38*a* of the bolt 38 (FIGS. 4 and 5) engages the sloping surface 53 of the plate 26 causing the bolt 38 to move upwardly at its free end and onto the surface 50. During such movement of the bolt 38, the shaft 35 rotates and moves the roller 40 away from the cam 47 where it remains as long as the doors 1 and 2 are closed. Therefore, if the other cams are properly adjusted, the roller 40 will not strike them as the car 5 arrives at the various landings. Striking, with its noise, is to be distinguished from the relatively noiseless engagement of the roller 40 with a cam when the bolt 38 leaves the surface 50.

Let it now be assumed that the car 5 is at a position in the hoistway 41 where the roller 40 cannot engage a cam 45–47, etc., and for some reason, e.g. power or control failure, the car 5 stops. If an attempt is then made by a passenger within the car to force the doors 1 and 2 apart, the doors 1 and 2 will separate until the locking means or bolt 38 moves into the notch 27 of the stop means or plate 26 and engages the surface 54 (FIG. 3) of the projection 48. The doors 1 and 2 can then not be separated further. The spacing between the surface 50 and the surface 54 as well as the position of the bolt 38 relative to the right end of the surface 50, as viewed in FIG. 3, determines the amount that the doors 1 and 2 can be separated further. As previously mentioned, the doors 1 and 2 should become locked at least by the time the separation therebetween reaches about four inches. However, to provide the feature of absence of the noise of a cam follower (roller 40) striking a cam (45–47), etc.), the doors 1 and 2 are permitted to separate by an amount sufficient to allow for the bolt 38 to rest on the surface 50 and to ride thereoff and thereby, to produce the movement of the roller 40 away from and toward a cam.

It will be apparent from the foregoing that the locking apparatus or latching means of the invention requires relatively few and relatively inexpensive parts and that it may be installed in an elevator system, either existing or new, relatively easily. Also, the apparatus may be installed in an elevator system without any substantial modification of the conventional apparatus of an elevator system, including the control apparatus.

Furthermore, the doors 1 and 2 of the car may be released from outside the car 5 without the use of special tools, it being merely necessary to lift the bolt 38 or to depress cam follower 40, manually. The locking apparatus of the invention is also inaccessible to a passenger within the car 5 even when the doors 1 and 2 are opened by the permitted amount.

Of course, when normal operation of the elevator car resumes, the locking apparatus of the invention will operate as described without any resetting of its parts.

Figure 9:
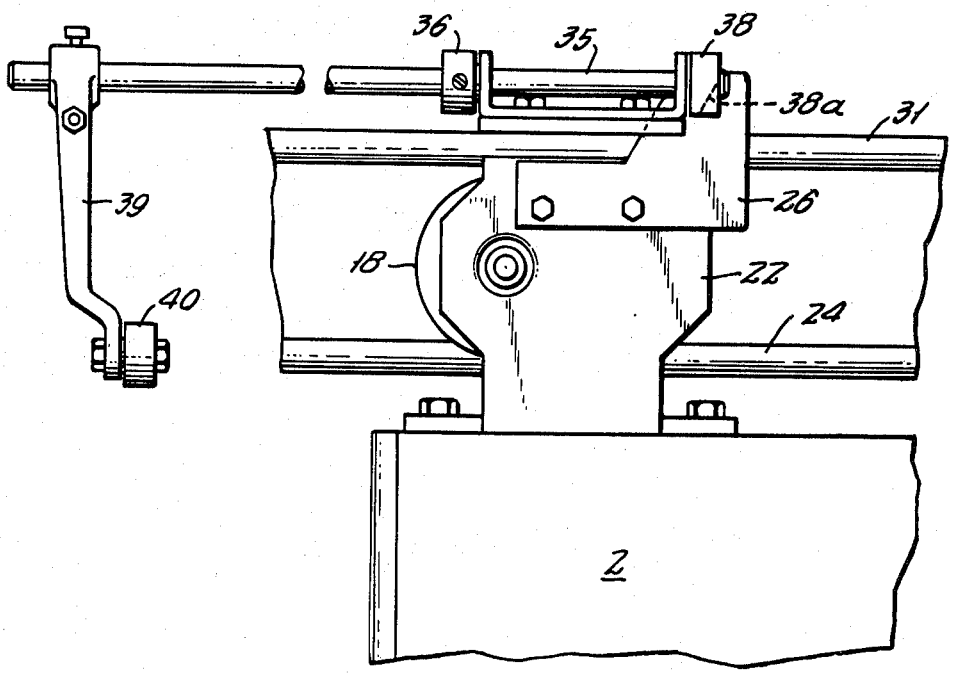
FIG. 9 is similar to FIG. 2 but illustrates the notch plate of the apparatus of the invention installed on a different car door.
Figure 10:
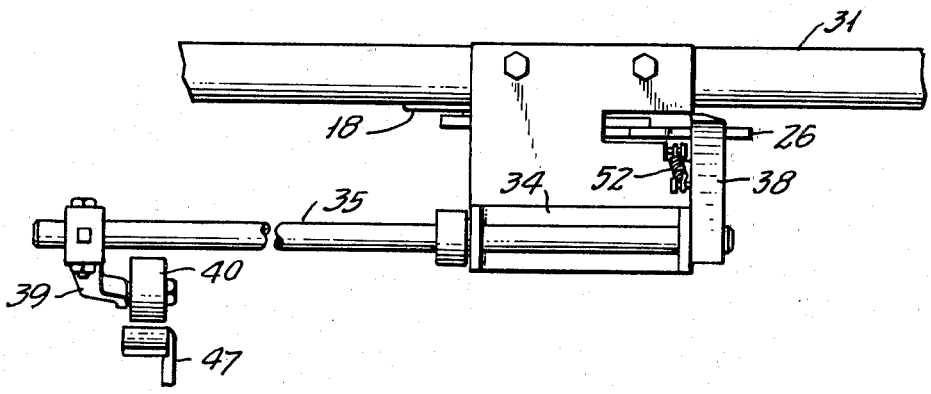
FIG. 10 is a plan view of the apparatus shown in FIG. 9.

If desired, the stop means or plate 26 may be mounted on the door 2 rather than the door 1 as illustrated in FIGS. 9 and 10 by mere reversal of some of the parts and substitution of a locking bolt 38 having an oppositely sloping face 38*a*. The operation of the locking apparatus is the same as that described hereinbefore.

In some cases, the noise of a cam follower striking a cam in a hoistway may be tolerable, particularly if the follower need not exert a substantial mechanical force to operate a lock bolt. In such cases, it is possible to interconnect the cam follower with the lock bolt by an electrical circuit including a solenoid for operating the lock bolt. However, in such cases, it is desirable to have a stand-by electrical power supply on the elevator car which can energize the solenoid in the event of a main power supply failure, both to permit operation of the bolt and release of the doors from externally of the car and to permit release of the doors when a car is moved to a landing while the main power supply is still inoperative. The use of an electrical circuit to interconnect the cam follower with the lock bolt has the advantage of being installable in cases where there are obstructions which do not permit the installation of the locking apparatus of FIGS. 1–10.

Figure 11:
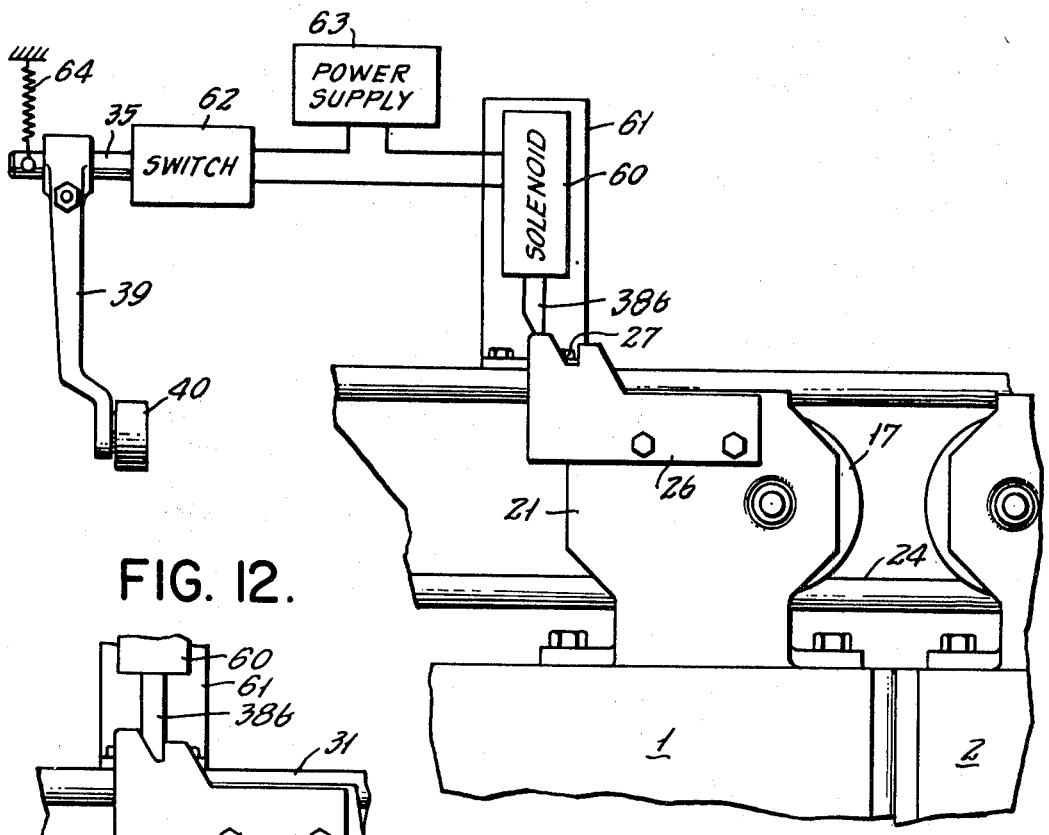
FIG. 11 is partly a plan view and partly a schematic diagram of an alternative embodiment of the invention in which the lock bolt is operated by a solenoid.
Figure 12:
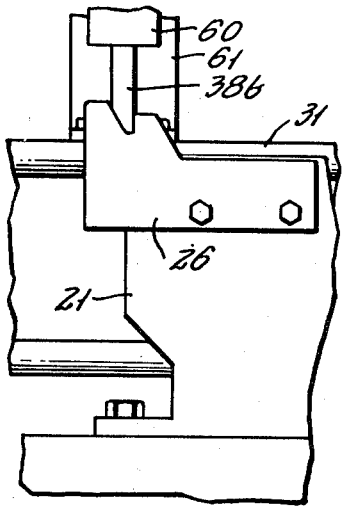
FIG. 12 is an elevation view of a portion of the apparatus shown in FIG. 11 and illustrates the relative position of the parts after the car door has been partly opened.

FIG. 11 illustrates an electrical circuit for connecting the cam follower or roller 40 and the lock bolt 38*b* which is movable by the field of a solenoid 60 mounted on a simple bracket 61 secured to the channel 31. The plate 26 is the same as the plate 26 previously described and is mounted on the hanger 21 in the same manner. FIG. 11 illustrates the relative positions of the bolt 38*b* and the plate 26 when the doors 1 and 2 are closed, and FIG. 12 illustrates their relative positions when the solenoid 60 is not energized and the doors 1 and 2 are prevented from opening further.

The electrical circuit for connecting the roller 40 and the lock bolt 38*b* includes, in addition to the solenoid 60, a switch 62 operable when the shaft 35 is rotated and a power supply 63. The switch 62 is in circuit with the power supply 63 and the solenoid 60 for energizing the solenoid 60, and thereby either retracting, or preventing downward movement of, the bolt 38*b*, when the roller 40 engages a cam 45–47, etc. In this arrangement, the arm 39 is adjustable relative to the movement of the contacts of the switch 62 and to the cams 45–47, etc. so that when the car 5 approaches a landing, the roller 40 engages the cam associated with the landing and closes the controls of the switch 62. When the roller 40 is in between the cams of two landings, the shaft 35 is rotated by a spring 64 to cause the contacts of the switch 62 to open.

Accordingly, when the floor of the car 5 is within a predetermined, safe distance of a landing, the solenoid 60 is energized, and the bolt 38*b* cannot enter into the notch 27 of the plate 26 when the doors 1 and 2 are opened, the door 1 moving to the left, as viewed in FIG. 11, as the doors are opened. On the other hand, when the roller 40 is not in engagement with a cam 45–47, etc., the contacts of the switch 62 are open and the solenoid 60 is not energized. Therefore, when the door is then moved to the left, the bolt 38*b* moves into the notch 27, as shown in FIG. 12, and prevents further opening of the doors 1 and 2.

Figure 13:
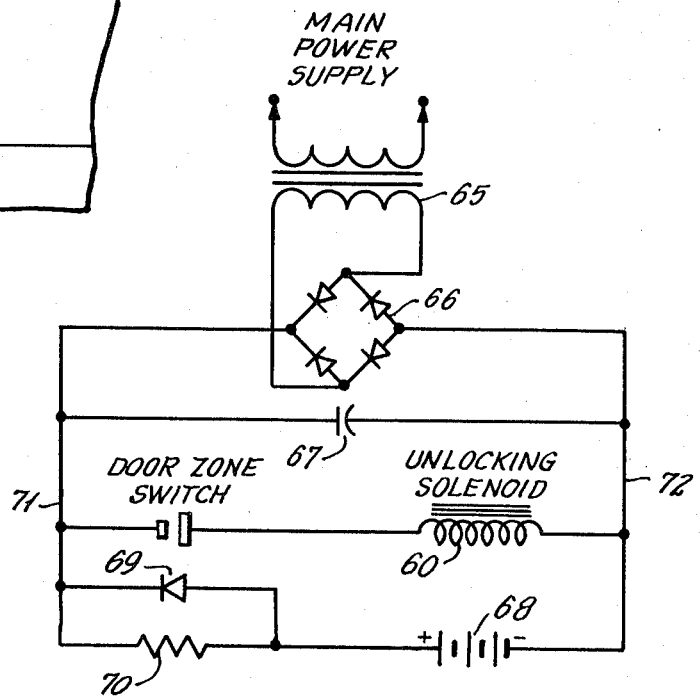
FIG. 13 is a circuit diagram for the apparatus shown in FIGS. 11 and 12.

FIG. 13 is a circuit diagram of one form of stand-by power supply 63 and circuit which may be mounted on the car 5 to energize the solenoid 60 in the event of failure of the main power supply. The power supply 63 comprises a transformer 65 connected to the main power supply, a bridge rectifier 66, a capacitor 67, a battery 68, a rectifier 69 and a resistor 70. The contacts of the switch 62 are connected in series with the solenoid 60 between the power supply lines 71 and 72 so that the battery 68, which is maintained charged by the main power supply, can energize the solenoid 60 in the event that the supply of electrical power from the main power supply is interrupted.

In the embodiment illustrated in FIGS. 11 and 12, it is possible to eliminate the shaft 35, the arm 39, the roller 40 and the cams 45–47, etc. if there are contacts on the conventional controller which are closed only when the car 5 is within the landing zone and if they close whether or not there is a power failure. Thus, the contacts of the switch 62 shown in FIG. 13 would be replaced by such contacts of the controller. This modified embodiment would eliminate any noise which may be caused by the striking of a cam 45–47, etc. by the roller 40 but requires the availability of contacts on the controller to replace the switch 62 and electrical wiring from the controller to the power supply 63 and the solenoid 60.

Another way to eliminate any noise which may be caused by the roller 40 striking a cam on the hoistway is to eliminate the shaft 35, the arm 39, the roller 40 and the cams 45–47, etc. and to substitute a magnetically operable switch for the switch 62. Such a magnetically operable switch is well-known in the art and closes its contacts when a magnetic member is brought close thereto. One type of such a magnetically operable switch is known as a Type LU switch and is manufactured and sold by the G.A.L. Manufacturing Corporation identified hereinbefore.

Figure 14:
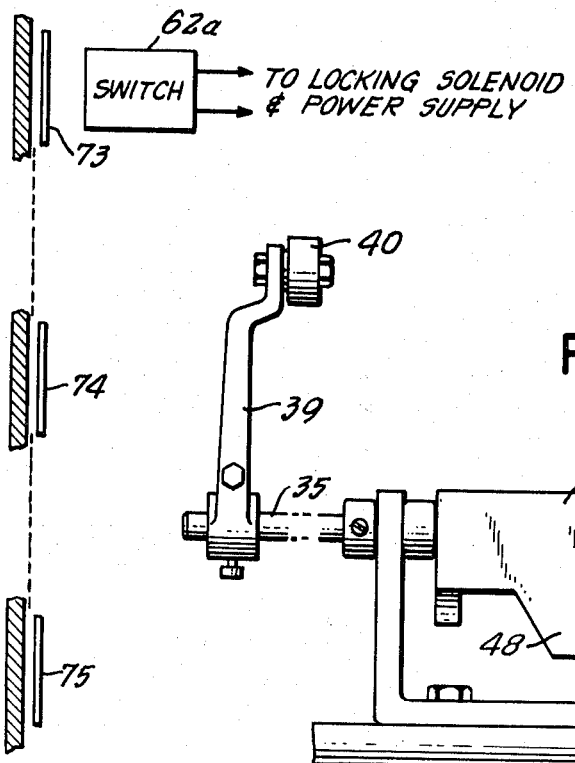
FIG. 14 is a schematic diagram illustrating an alternative embodiment in which the switch illustrated in FIGS. 11 and 12 is magnetically rather than mechanically operated.

FIG. 14 illustrates schematically an embodiment in which a magnetically operable switch **62*a* is substituted for the mechanically operable switch 62, the shaft 35, the arm 39 and the roller 40, and the cams 45–47, etc. are replaced by magnetic members 73–75, etc. mounted on a side of the hoistway so that the switch 62*a* is actuated when the floor of the car 5 is within a predetermined, safe distance of a landing. The members 73–75, etc. accomplish the functions of the cams 45–47, etc., and are selected in the same manner as the cams 45–47, etc. to cause energization or deenergization of the solenoid 60 in accordance with the position of the car 5. However, it is not necessary that the switch 62*a* engage a member 73, 74, 75, etc. to cause closing of the contacts of the switch 62*a*. Mere proximity of a member 73–75, etc. to the switch 62*a*** is sufficient to close the contacts.

Figure 15:
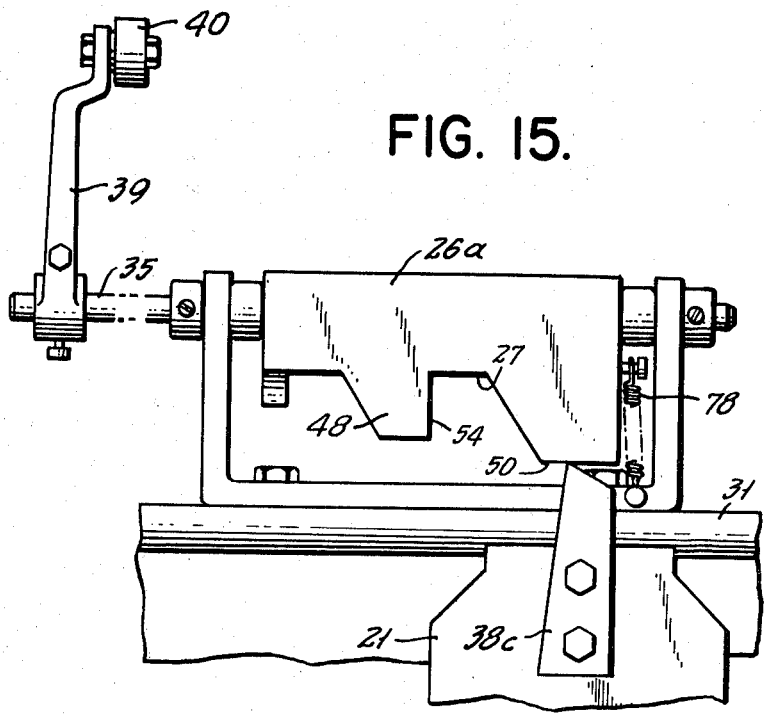
FIG. 15 is a fragmentary, front elevation view illustrating an alternative embodiment of the invention.
Figure 16:
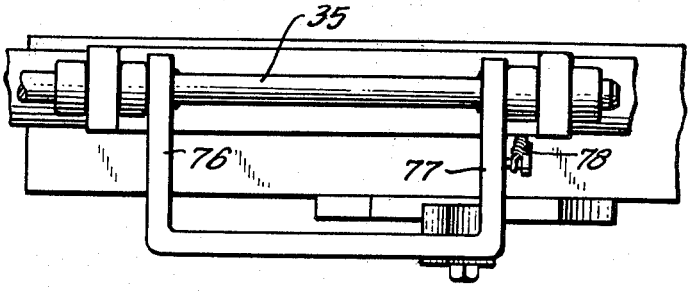
FIG. 16 is a plan view of the apparatus illustrated in FIG. 15.

In the embodiments illustrated in FIGS. 1–10, the plate 26 is on a car door and the bolt 38 or **38*a* is on another portion of the car 5, i.e. the rail 31. FIGS. 15 and 16 illustrate a modified plate 26*a* mounted on the car rail 31 and a lock bolt 38*c* mounted in a fixed position on the hanger 21 of the car door 1**.

In FIGS. 15 and 16, a plate **26*a* having a pair of extensions 76 and 77 is secured at the extensions 76 and 77 to the shaft 35 so as to rotate therewith. The surface 50 of the plate 26*a* is urged toward the end of the bolt 38*c* by a spring 78, FIGS. 15 and 16 showing the positions of the parts when the doors 1 and 2 are closed. The arm 39 and the cams 45–47, etc. are adjusted as described in connection with FIGS. 1–10 so that when the end of the bolt 38*c* engages the surface 50 of the plate 26*a*, the roller 40 is slightly spaced from the cam surfaces. When the car 5 is at a landing and the car doors 1 and 2 are opened, the operation of the locking apparatus is as described in connection with FIGS. 1–10, the engagement of the roller 40 with a cam preventing the bolt 38*c* from entering the notch 27. Similarly, when the floor of the car 5 is not within a predetermined, safe distance of a landing and the doors 1 and 2 separate by a small amount, the shaft 35 rotates an amount sufficient to pivot the surface 54 of the projection 48 into the path of the bolt 38*c* preventing further opening of the doors 1 and 2. Of course, because of the engagement of the bolt 38*c* with the surface 50 when the doors are closed, the roller 40 will not strike the cams 45–47, etc. when the car 5** moves with its doors closed.

In the embodiment illustrated in FIGS. 1–10, the roller 40 is on an arm 39 secured to the shaft 35 which actuates the bolt 38, the roller 40 being carried by the car 5 and the cams 47, etc. being mounted in fixed positions on the hoistway wall. If desired, the cams may be replaced by a series of rollers **40*a*, one for each floor, and the arm 39 and the roller 40 may be replaced by a pivotally mounted cam 80 which is mounted on the car 5 as illustrated in FIG. 17. The cam 80 acts in the same manner as the arm 39 and the roller 40 and is pivotally mounted at the ends of a pair of arms 81 and 82, the opposite ends of which are pivotally mounted on the car 5. The arm 81 rotates a gear 83 which engages a gear 84 secured to the shaft 35 described in connection with FIGS. 1–10. The purpose of the gears 84 and 84 is to translate the motion of the cam 80 into the correct direction of rotation of the shaft 35 for the actuation of the bolt 38, but it will be apparent that the mechanical devices other than gears may be employed to obtain the correct direction of rotation of the shaft 35**.

In the embodiments previously described, except for the embodiment described in connection with FIG. 13, it is necessary to make an installation of a device, such as a cam 46 etc., or a roller **40*a***, at each of the landings to produce the desired operation of the latch in relation to the keeper. Many elevator installations have a clutch mounted on the car doors which cooperates with rollers mounted on the hoistway doors to cause opening and closing of the hoistway doors with the car doors. In the further embodiment of the invention described hereinafter, the latch operating mechanism is installed on such a clutch so that when the car is at or near a landing, the latch cannot enter the notch in the keeper because part of the operating mechanism engages a roller or the rollers, on the hoistway door. However, when the car is a sufficient distance from a landing, such part of the latch operating mechanism cannot engage a roller, or the rollers, which permits the latch to enter the notch in the keeper when the car door is opened by a small amount. With this embodiment, it is not necessary to install a device at each of the landings to operate the latch. In other words, this embodiment takes advantage of apparatus already installed in an elevator system for other purposes.

The last-mentioned further embodiment is illustrated in FIGS. 18–25, and FIG. 18 illustrates one of two car doors, door 2, of a known type of elevator installation which includes a known type of door operating mechanism 90 connected to the door 2 by levers 91–94. The lever 94 operates a known type of clutch mechanism generally designated by the numeral 95 and described hereinafter in further detail. The door 2 is interconnected with another door of the car (not shown) in a conventional manner so that when the door 2 is prevented from opening, the other car door is also prevented from opening.

The clutch 95 comprises a plate 96 pivotally mounted on a shaft 97 supported on a base 98 secured to the car door 2. The plate 96 is biased away from the car door 2 by a spring 99 (FIG. 24), and its movement away from the door 2 is limited by a stop (not shown). However, the plate 96 can have limited pivotal movement toward the door 2.

The clutch 95 also comprises a bar 100 which is pivotally mounted on the shaft 97 and which is movable toward the door 2 by the lever 94 connected to the bar 100 by means of a cam (not shown). The bar 100 is biased away from the door 2 by a spring (not shown) but when the door 2 is closed, the lever 94 holds the bar 100 in its position nearest the door 2 as illustrated in FIG. 24. However, when the door 2 opens by a predetermined amount, the bar 100 is permitted to move away from the door 2 for reasons described hereinafter.

The clutch 95 does not form part of the invention, but it provides a convenient support for the apparatus of the invention and a location on the car door 2 which permits a part of the apparatus of the invention to cooperate with means normally on a hoistway door 101 (FIG. 19) for other purposes.

The leading edge of the hoistway door 101 is designated by the numeral 102. Normally, there is a second door (not shown) which is like the door 101 and which operates with the door 101 to cover and uncover the hoistway opening at a floor or landing. The door 101 carries a pair of rollers 102 and 103 mounted on a base 104 secured to the door 101. The roller 103, which is engaged by the plate 96 when the door 2 opens, is rotatably mounted at the end of one arm of a bell crank 105, the end of the other arm of the bell crank 105 being pivotally connected to one end of a link 106. The other end of the link 106 ia pivotally connected to a latch 107 pivotally mounted on a hanger 108 for the door 101. The latch 107 cooperates with a box 108, in a known manner, to operate interlock switches within the box 108 and to prevent opening of the door 101 before the latch 107 is lifted by the engagement of the plate 96 with the roller 103.

The clutch 95 and the rollers 102 and 103 cooperate, in a known manner, to cause the door 101 to open and close when the door 2 opens and closes. Such cooperation is the same with or without the apparatus of the invention mounted on the clutch 95.

Thus, when the door 2 is closed, the plate 96 and the bar 100 have the positions shown in FIG. 24. As the door 2 opens, the plate 96 and the bar 100 remain in such positions until the plate 96 engages the roller 103 as shown in FIG. 20, at which time the roller 103, through the bell crank 105 and the link 106, lifts the latch 107, unlocking the door 101. As the door 2 opens further, it moves the hoistway door 101 toward its open position by means of the contact of the plate 96 with the roller 103.

Shortly after the plate 96 engages the roller 103, the lever 94 releases the bar 100 permitting it to assume the position shown in FIG. 21 in which it remains during the opening of the door 101 and until the door 101 is returned to its closed position by means of the contact between the bar 100 and the roller 105. As the door 101 arrives at a position close to its closed position, the lever 94 retracts the bar 100 toward and into the rest position thereof shown in FIG. 24.

The apparatus of the invention comprises a keeper 109, like the keeper 26 previously described but secured in a fixed position on the car, e.g. on the door rail 110 (FIG. 18). The keeper has a notch 111 and a surface 112 which is higher than the bottom of the notch 111 and higher than the upper surface of the projection 113. Such apparatus also comprises a metal strip 114, having a reinforcing extension 115, mounted on a pair of arms 116, only one of which is shown in FIG. 22. The arms 116 are pivotally mounted on the shaft 97 so as to permit the strip 114 to move toward and away from the car door 2. The strip 114 is bent at its ends 117 toward the door 2 so that while not normally necessary, the strip 114 can ride over the rollers 102 and 103 during vertical movement of the elevators. The strip is biased away from the door 2 by a spring 118 (FIG. 24).

The upper arm 116 has a U-shaped extension 119 (FIGS. 22 and 25) which receives a roller 120 rotatably mounted on the end of one arm of a bell crank 121 which is pivotally mounted at 122 on a bracket 123 extending upwardly from the base 98. The end of the other arm of the bell crank 121 carries a pin 124 which is pivotally secured to one end of a link 125 which, at its other end, pivotally engages a pin 126 secured to a link 127. The upper end of the link 127 has a bent over portion 128 which acts as a latch as described hereinafter.

The link 127 may be adjustable in length and the length of the links 127 and 125 are selected so that when the door 2 is closed and the portion 128 of the link 127 is on the surface 112 of the keeper 109, the strip 114 is held in the position shown in FIG. 24. In such position, the strip 114 cannot contact the rollers 102 and 103 as the car passes floors thereby eliminating any noise of contact between the strip 114 and the rollers 102 and 103.

The length of the links 127 and 125 are also selected so that when the car stops at a floor and the door 2 commences to open, the strip 114 will engage a roller 102 or 103, or both, and will prevent the latch portion 128 from entering into the notch 111 of the keeper 109. However, if the car stops at a position which is at a distance from a floor such that the strip 114 cannot engage a roller 102 or 103, then, the strip 114 will move, under the bias of the spring 118, away from the door 2, as the door 2 opens, by an amount sufficient to cause the latch portion 128 to enter the notch 111 in the keeper 109 and thereby prevent further opening of the door 2. The magnitude of such distance is, of course, determined by the length of the strip 114 which is selected so that the car doors will be prevented from opening by an amount sufficient to permit the exit of a passenger from the car when the car is more than a distance from the floor which will permit the safe exit of a passenger from the car.

It will be apparent that this last-described embodiment accomplishes the objectives of the invention without the need for installing special latch operating devices at each of the floors or landings. In such embodiment, it is merely necessary to install a few parts on the car of an existing installation, or on each car of an existing multi-car installation, to provide the desired locking of the car door or doors.

However, it will be apparent to those skilled in the art that the apparatus of the last-described embodiment may be used in elevator systems which do not employ a clutch carried by the hoistway door. For example, the apparatus of such embodiment may be mounted on a car door in the absence of a clutch, and a means which projects from the hoistway door similar to the manner in which the roller 102 or 103 projects therefrom may be installed on the corresponding hoistway door of each floor to provide the operation described.

Although preferred embodiments of the present invention have been described and illustrated, it will be apparent to those skilled in the art that various modifications may be made without departing from the principles of the invention.

What is claimed is:

1. In a passenger transportation system in which a passenger carrying vehicle moves along a selected path and stops at predetermined points to permit passengers to exit from said vehicle, said vehicle having a door thereon which travels therewith and which opens to permit the exiting of passengers from the vehicle, the combination therewith of:

latching means carried by said vehicle and acting between the door and another portion of the vehicle for permitting opening of said door by a predetermined amount less than the amount required for a passenger to exit from the vehicle and for preventing opening of said door by more than said predetermined amount, said latching means comprising stop means on said another portion of said vehicle and locking means on said door movable therewith and engagable with and disengagable from said stop means;

control means which is responsive to the position of said vehicle, which is connected to said latching means and which disables said latching means when said vehicle is within a predetermined distance from a said point and thereby permits said vehicle door to open more than said predetermined amount when said vehicle is within a predetermined distance from a said point, said distance being small relative to the distances between said points, said control means comprising operating means mounted on said door and movable toward and away from said door, said operating means being connected to said locking means for preventing said locking means from engaging said stop means when said operating means is in a first position near said door and for permitting said locking means to engage said stop means when said operating means is in a second position farther from said door; and further means at each of said points for preventing said operating means from moving into its said second position when said vehicle is at a point.

2. A system as set forth in claim 1 wherein said latching means is innaccessible to a passenger within said vehicle and is accessible from externally of said vehicle whereby said latching means may be manually disabled from externally of said vehicle.

3. A system as set forth in claim 1 wherein said vehicle is an elevator car mounted for movement in a hoistway between a plurality of floors, said car having said door which opens to permit exiting of passengers at each of said floors and said floors corresponding to said points, said hoistway having a door at each of said floors to permit passengers to enter into and exit from a car at a floor and wherein said operating means comprises a strip extending substantially parallel to the face of said car door and connected to said locking means, and mounting means mounting said strip on said car door and wherein said further means comprises strip engaging means mounted on the hoistway door at each of said floors and projecting from the hoistway door toward said car door.

4. A system as set forth in claim 3 wherein said mounting means comprising a clutch mounted on said car door for engaging said further means and moving a hoistway door with said car door.

5. A system as set forth in claim 4 wherein said stop means comprises a keeper with a notch mounted on a fixed portion of said car and said locking means comprises a latch receivable in said notch and movable in a direction substantially parallel to the face of said door, wherein said strip is movable around an axis substantially parallel to the face of said car door and wherein said strip is connected to said latch by linking means which converts movement of said strip around said axis into movement of said latch in a direction substantially parallel to the face of said door.

6. In an elevator system which comprises an elevator car which is mounted for movement in a hoistway between a plurality of floors, said car having a door thereon which travels therewith and which opens to permit passengers to exit from the car, the combination therewith of:

latching means carried by said car and acting between said door and another portion of the vehicle for preventing opening of said door by an amount sufficient to permit a passenger to exit from the car, said latching means comprising interengageable stop means and locking means, one of said stop means and said locking means being mounted on said door and the other of said stop means and said locking means being mounted on another portion of said car; and control means which is responsive to the position of said car and which is connected to one of said stop means and said locking means for preventing interengagement thereof when said car is within a predetermined distance from a said floor to thereby permit said door to open by an amount sufficient to permit a passenger to exit from the car, said control means comprising operating means mounted on said door and movable toward and away from said door, said operating being being connected to said lastmentioned one of said stop means and said locking means for preventing interengagement of said locking means and said stop means when said operating means is in a first position near said car door and for permitting interengagement of said locking means and said stop means when said operating means is in a second position farther from said car door, and means at each of said floors engageable with said operating means when said car is within said predetermined distance from said floor for preventing said operating means from moving into its said second position when said car is within said predetermined distance from said floor.

* * * * *